US012029337B2

(12) United States Patent
Hawley et al.

(10) Patent No.: US 12,029,337 B2
(45) **Date of Patent: *Jul. 9, 2024**

(54) RECEPTACLE RACK FOR STACKABLE RECEPTACLES

(71) Applicant: Desmond Hawley, Oshawa (CA)

(72) Inventors: Desmond Hawley, Oshawa (CA); Timothy Teatro, Oshawa (CA)

(73) Assignee: Desmond Hawley, Oshawa (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/063,971

(22) Filed: Dec. 9, 2022

(65) Prior Publication Data

US 2023/0104648 A1 Apr. 6, 2023

Related U.S. Application Data

(63) Continuation of application No. 17/018,952, filed on Sep. 11, 2020, now Pat. No. 11,523,698, which is a continuation of application No. 16/503,315, filed on Jul. 3, 2019, now Pat. No. 10,791,860, which is a continuation of application No. 15/962,588, filed on Apr. 25, 2018, now Pat. No. 10,342,369, which is a continuation of application No. 15/304,337, filed as (Continued)

(51) Int. Cl.
*A47G 23/02* (2006.01)
*A47F 1/06* (2006.01)

(52) U.S. Cl.
CPC ..... *A47G 23/0208* (2013.01); *A47F 1/065* (2013.01); *A47B 2220/0094* (2013.01); *A47G 2400/025* (2013.01)

(58) Field of Classification Search
CPC ..... A47G 23/0208; A47G 2400/02; A47G 2400/025; A47G 2400/022; A47F 7/0064; A47F 1/065; A47B 2220/0094
USPC ..... 211/85.18; 248/346.03, 349.1
See application file for complete search history.

(56) References Cited

U.S. PATENT DOCUMENTS

| | | | |
|---|---|---|---|
| 1,634,953 | A | 7/1927 | McCune |
| 1,704,047 | A | 3/1929 | Lippert |
| 2,230,975 | A | 2/1941 | Gratz |

(Continued)

FOREIGN PATENT DOCUMENTS

| | | | |
|---|---|---|---|
| CH | 704271 | A1 | 6/2012 |
| CN | 2176087 | Y | 9/1994 |

(Continued)

OTHER PUBLICATIONS

International Search Report and Written Opinion in International Application No. PCT/CA2015/050315, dated Jun. 10, 2015.

*Primary Examiner* — Brian E Glessner
*Assistant Examiner* — Daniel J Kenny
(74) *Attorney, Agent, or Firm* — Knobbe, Martens, Olson & Bear, LLP

(57) ABSTRACT

A receptacle rack including a base providing a surface for abutting support for a retainer plate and a plurality of mounting receptacles; the retainer plate coupled to the base; the plurality of mounting receptacles integrally molded to the retainer plate; the retainer plate moveable from a first closed position parallel and proximal to the surface for abutting support to a second open position; a back panel extending from the base, the back panel substantially perpendicular relative to the surface for abutting support, an electronic display installed in the back panel.

20 Claims, 7 Drawing Sheets

Related U.S. Application Data application No. PCT/CA2015/050315 on Apr. 15, 2015, now Pat. No. 9,986,860.

(60) Provisional application No. 61/981,072, filed on Apr. 17, 2014.

(56) References Cited

U.S. PATENT DOCUMENTS

| | | | |
|---|---|---|---|
| 2,281,849 | A | 5/1942 | McCoppin |
| 2,705,089 | A | 3/1955 | Bennett |
| 3,246,798 | A | 4/1966 | Stone |
| 3,478,457 | A | 11/1969 | Watkins |
| 4,228,918 | A | 10/1980 | Kellogg |
| 4,482,079 | A | 11/1984 | Kuchenbecker |
| 4,664,255 | A | 5/1987 | Griffith |
| 4,782,957 | A | 11/1988 | Kernodle, Sr. |
| 5,702,029 | A | 12/1997 | Yang |
| 5,743,605 | A | 4/1998 | Marino |
| 7,353,970 | B1 | 4/2008 | Harrison |
| 2005/0077314 | A1 | 4/2005 | Boykin |
| 2006/0113263 | A1 | 6/2006 | Kratochvil |
| 2007/0012067 | A1 | 1/2007 | Kaplan |
| 2007/0012068 | A1 | 1/2007 | Kaplan |
| 2007/0062892 | A1 | 3/2007 | Donnellan |
| 2007/0186580 | A1 | 8/2007 | Kaplan |
| 2007/0264167 | A1 | 11/2007 | Warner |
| 2010/0089850 | A1 | 4/2010 | Hovatter |
| 2012/0118902 | A1 | 5/2012 | Beltrante |
| 2012/0175328 | A1 | 7/2012 | Bosch |
| 2014/0034666 | A1 | 2/2014 | Woods |
| 2016/0227950 | A1 | 8/2016 | Minevich |
| 2016/0345784 | A1 | 12/2016 | Johnson |

FOREIGN PATENT DOCUMENTS

| | | | |
|---|---|---|---|
| DE | 3742636 | C1 | 1/1989 |
| FR | 1580382 | A | 9/1969 |
| FR | 2511473 | A1 | 2/1983 |
| GB | 191023674 | A | 4/1911 |

RECEPTACLE RACK FOR STACKABLE RECEPTACLES

CROSS-REFERENCE TO RELATED APPLICATIONS

This is a continuation of U.S. application Ser. No. 17/018,952, filed on Sep. 11, 2020, which is a continuation of U.S. application Ser. No. 16/503,315, filed on Jul. 3, 2019, which is a continuation of U.S. application Ser. No. 15/962,588, filed on Apr. 25, 2018, now U.S. Pat. No. 10,342,369, issued Jul. 9, 2019, which is a continuation of U.S. application Ser. No. 15/304,337, filed on Oct. 14, 2016, now U.S. Pat. No. 9,986,860, issued Jun. 5, 2018, which is a national stage application of International Patent Application No. PCT/CA2015/050315, filed on Apr. 15, 2015, which claims priority to U.S. Provisional Application Ser. No. 61/981,072, filed Apr. 17, 2014.

BACKGROUND OF THE INVENTION

Field of the Invention

The present invention relates generally to cup holders. In particular, countertop seated cup holders for food service application wherein a plurality of disposable cups may be stacked and held stable for display and easy access.

Description of the Related Art

A problem in the food service industry has long been the placement of disposable cups for easy access. If stacks of cups are simply left out on an open table, they pose sanitary problems, and are prone to being moved, upset or toppled.

Existing cup holders for this application are either difficult to keep clean, provide inadequate stability or are comparatively expensive.

Many restaurants have spring loaded cup holders recessed into cabinetry which are often located behind the counter for employees to quickly obtain a cup for service. However, they are rarely provided for customers. They are prone to jams, take up a great deal of space, and are costly and require professional installation. They are also difficult to clean and because the mechanism is below countertop level, spills will soil the entire contents of the cup holder, requiring that the cup holder be emptied for cleaning.

Accordingly, there is a continuing need for alternative cup holders.

SUMMARY OF THE INVENTION

In an aspect there is provided, a cup rack comprising:

a base providing a surface for abutting support for a plurality of cups;

a cup retainer plate coupled to the base;

a plurality of cup retaining apertures formed within the cup retainer plate, each cup retaining aperture sized to receive a corresponding cup and having a diameter smaller than the largest exterior diameter of the corresponding cup;

the cup retainer plate moveable from a first closed position parallel and proximal to the surface for abutting support to a second open position for insertion of cups within the cup retaining apertures.

DETAILED DESCRIPTION OF PREFERRED EMBODIMENTS

Figure 1:
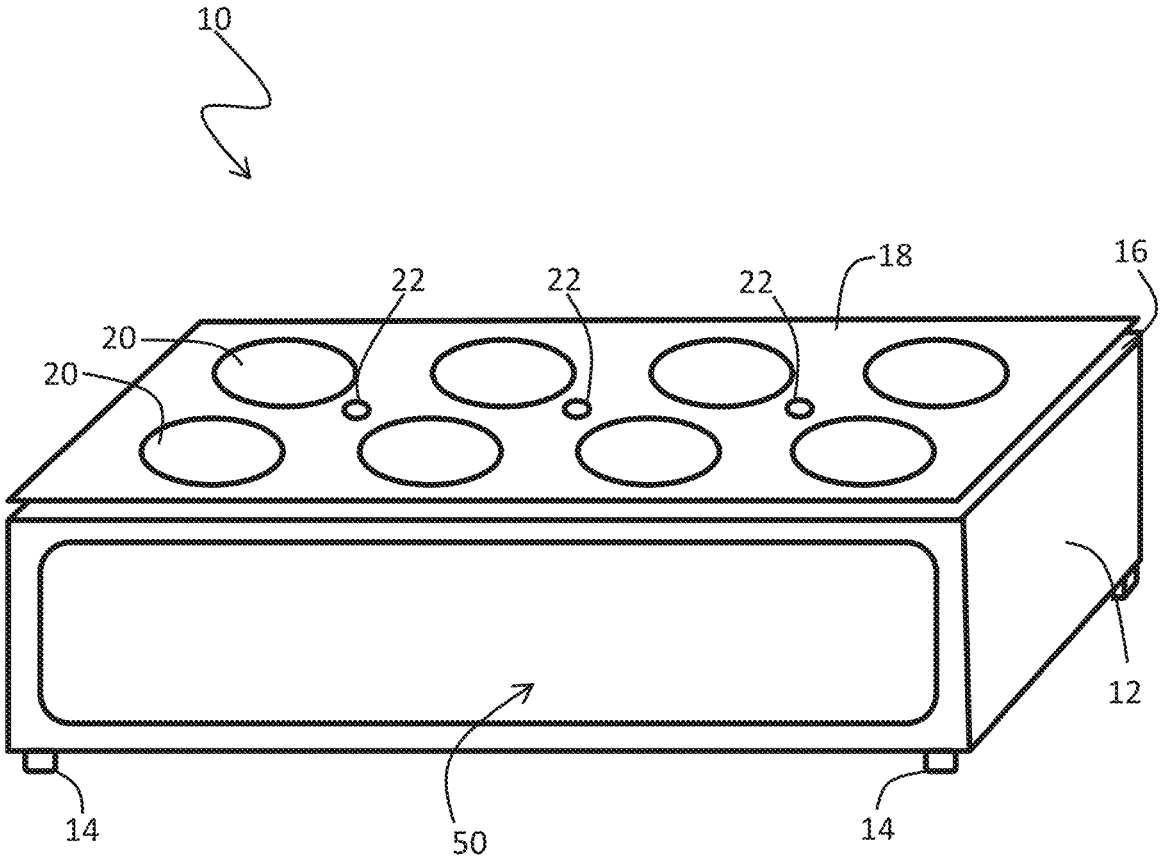
FIG. 1 is a front perspective view of a 4×2 array cup rack. No cups are shown so that the bare mechanism is visible.

Now referring to the drawings, with reference numerals summarized in Table 1, FIG. 1 illustrates an exemplary arrangement of a cup rack, a periodically spaced 4×2 array, shown generally at 10. No cups are illustrated so that the bare assembly is seen as a retainer plate 18 with cup retaining apertures 20 and fastened to a top planar surface 16 of a base 12. The cup retainer plate 18 is a rectangular sheet with roughly the same planar dimension as the top planar surface 16. The top planar surface 16 is the top surface of the hollow rectangular base 12. An electronic display 50 may be housed on the front face of the base 12, with supporting electronics recessed into the cavity of the rectangular base 12. The cavity of the base 12 can be fitted with brackets and stand-offs as needed to mount electronics for specific applications as desired. The rectangular base 12 includes cylindrical feet 14 near each corner of the bottom surface. The ratio of the sides of the base which create the top planar area is 4×2, corresponding to the 4×2 grid arrangement of the cup retainer plate 18. The cup retaining apertures 20 are circular holes arranged in a 4×2 array in the cup retainer plate 18. Three circular apertures 22 for receiving threaded fasteners 22 are found centrally in the interstitial regions between each nearest neighbour group of four cup retaining apertures 20.

Figure 2:
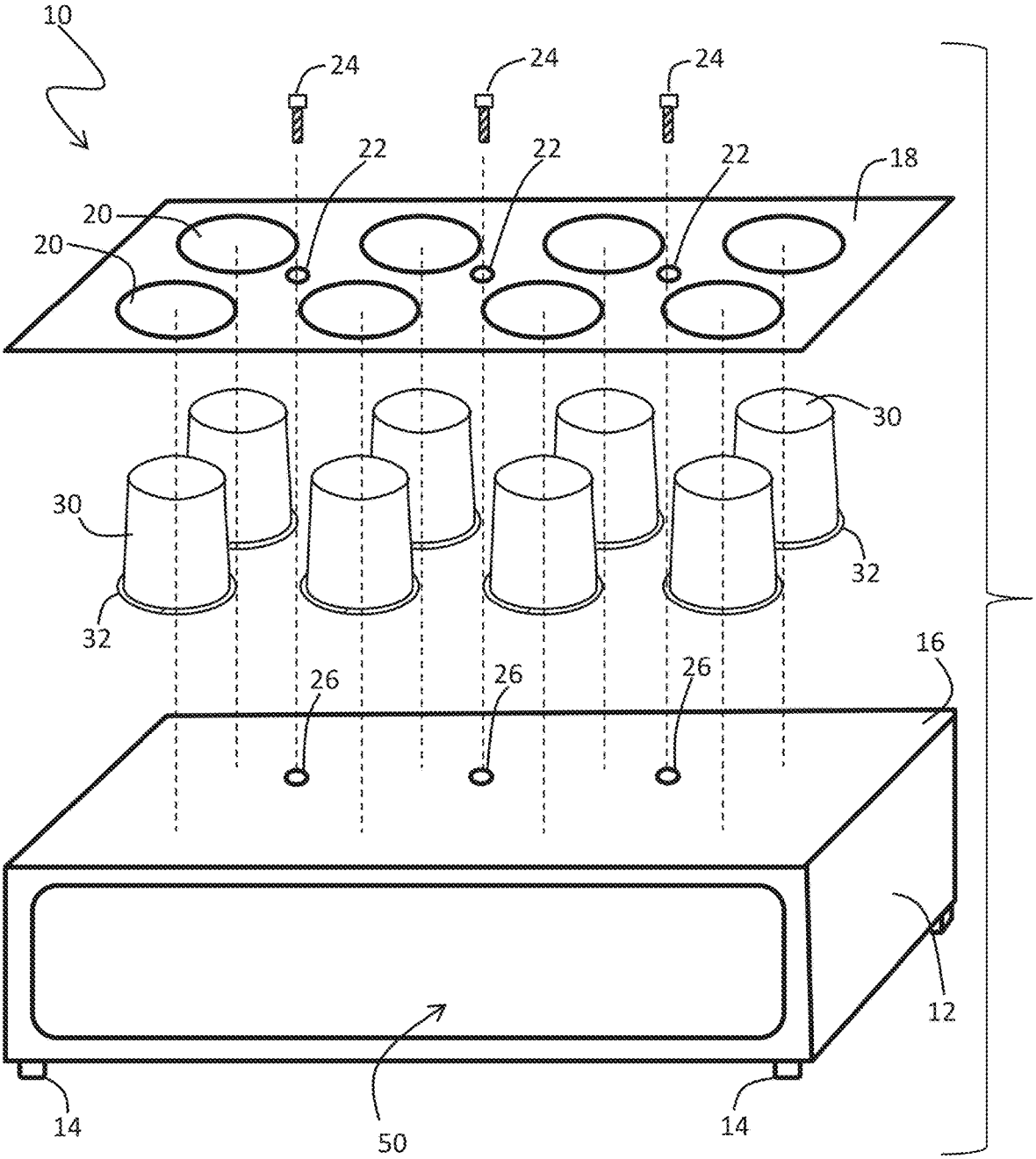
FIG. 2 is a perspective exploded view of the 4×2 array cup rack shown in FIG. 1, with insertion of mounting cups shown.

FIG. 2 is an exploded view of the cup rack, located generally at 10 that illustrates how the retainer plate 18 is mounted to the top planar surface 16 by threaded fasteners 24 that pass through fastener apertures 22 formed in the retainer plate 18 and are screwed into threaded bores 26 formed in the base 12 at the top planar surface 16. The threaded fasteners 24 include expanded heads that buttress against the surface surrounding the fastener apertures 22 and thereby fix the retainer plate 18 to the top planar surface 16 at the aligned fastener apertures 22 and threaded bores 26. The conical hull of the mounting cups 30 can pass vertically through the cup retaining apertures, but the outwardly flanged rims 32 of the mounting cups 30 cannot. Mounting cups 30 are positioned through the cup retaining apertures so that when collapsed, the outwardly flanged rims 32 are held in place by the interference/press fit of the outwardly flanged rims 32, abutted against the top planar surface 16 and held in place by the cup retainer plate 18. In the collapsed configuration, the threaded fasteners 24 are tightened to draw the cup retainer plate 18 onto the top planar surface 16. The outwardly flanged rims 32 of the mounting cups 32 are compressed or trapped in between the top planar surface 16 and the cup retainer plate 18 forming the interference/press fit.

Figure 3:
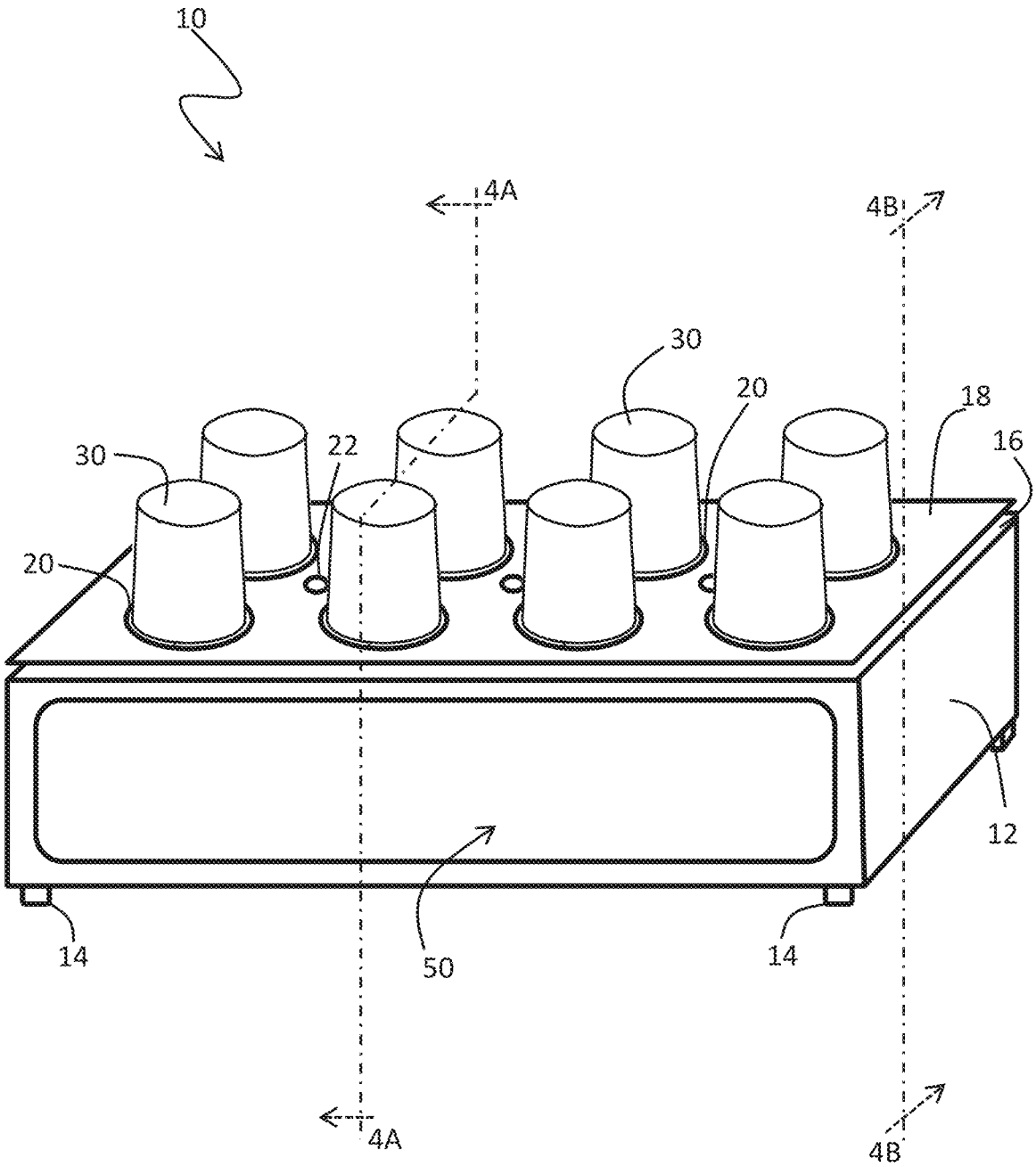
FIG. 3 is a front perspective view of a 4×2 array cup rack shown in FIG. 1 with mounting cups in place.

FIG. 3 is an assembled configuration of the cup rack shown in FIG. 2. The conical hull of each of the mounting cups 30 is positioned through a cup retaining aperture 20 of the cup retainer plate 18. The cup retainer plate 18 is fastened to the top planar surface 16 pressing the outwardly flanged rims 32 (unseen) between them, holding the mounting cups 30 in place. Two perpendicular planes are identified along line 4A-4A and line 4B-4B in the directions indicated by arrows perpendicular to those lines. The planes divide the cup rack 10 along the radial centres of the rows and columns of the 4×2 array of cup retaining apertures 20.

Figure 4A:
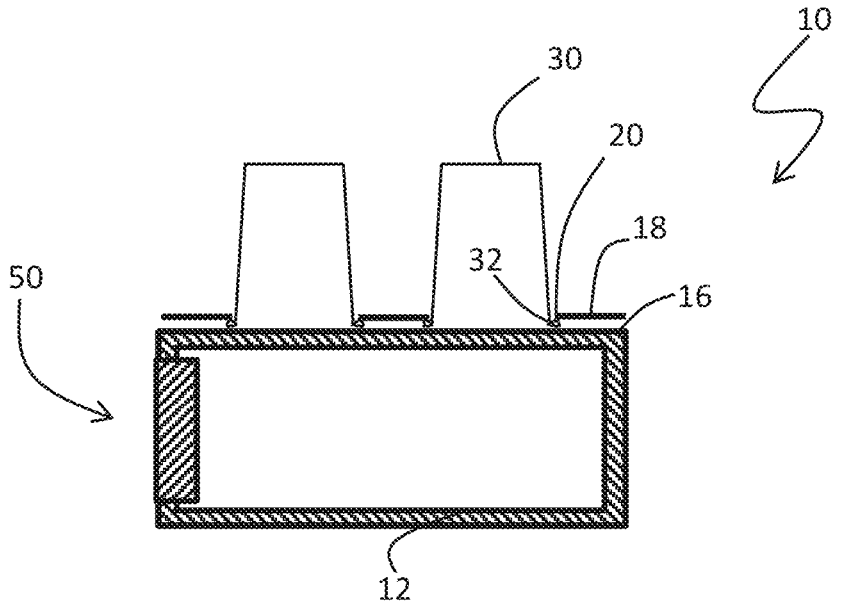
FIG. 4A is a cross-section view of the 4×2 array cup rack shown in FIG. 3 along the plane containing the line 4A-4A, in the indicated direction.

FIG. 4A is a cross section along the plane indicated by line 4A-4A in FIG. 3. This is a cross section along a plane dividing the cup rack 10 along the direction where the cup retaining apertures 20 are in columns of two. The top planar surface 16 is the top surface of the base 12 and provides abutting support against the outwardly flanged rims 32 of the mounting cups 30. The mounting cups 30 are held tight against the top planar surface 16 by the cup retainer plate 18.

Figure 4B:
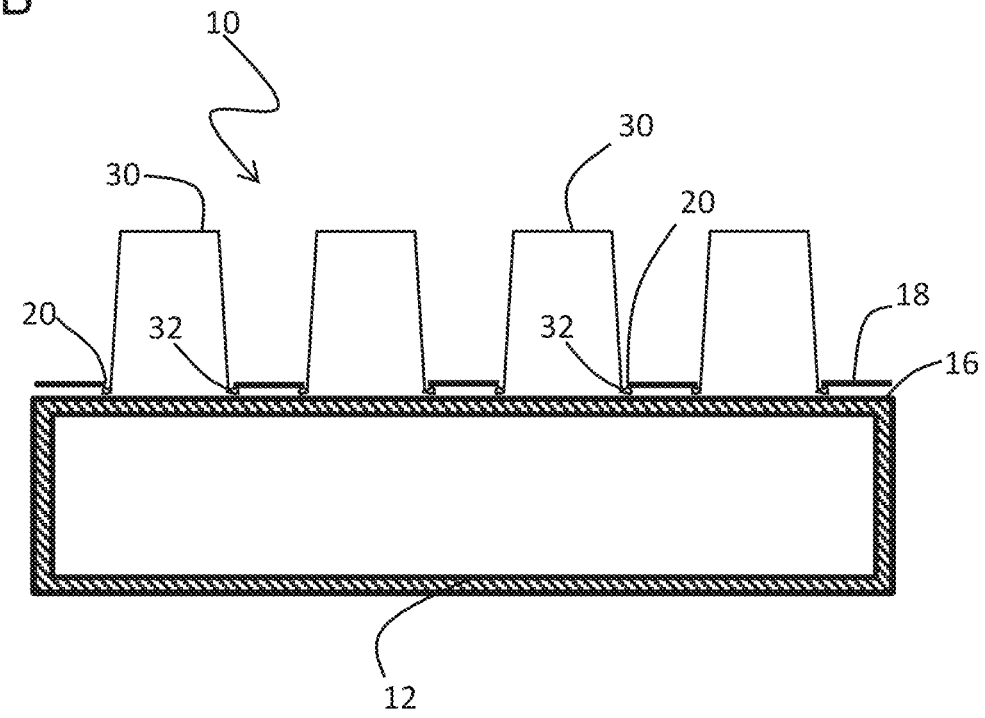
FIG. 4B is a cross-section view of the 4×2 array cup rack shown in FIG. 3 along the plane containing the line 4B-4B, in the indicated direction.

FIG. 4B is a cross section along the plane indicated by line 4B-4B in FIG. 3. This is a cross section along a plane dividing the cup rack 10 along the direction where the cup retaining apertures 20 are in rows of 4. The top planar surface 16 is the top surface of the base 12 and provides abutting support against the outwardly flanged rims 32 of the mounting cups 30. The mounting cups 30 are held tight against the top planar surface 16 by the cup retainer plate 18.

Figure 5:
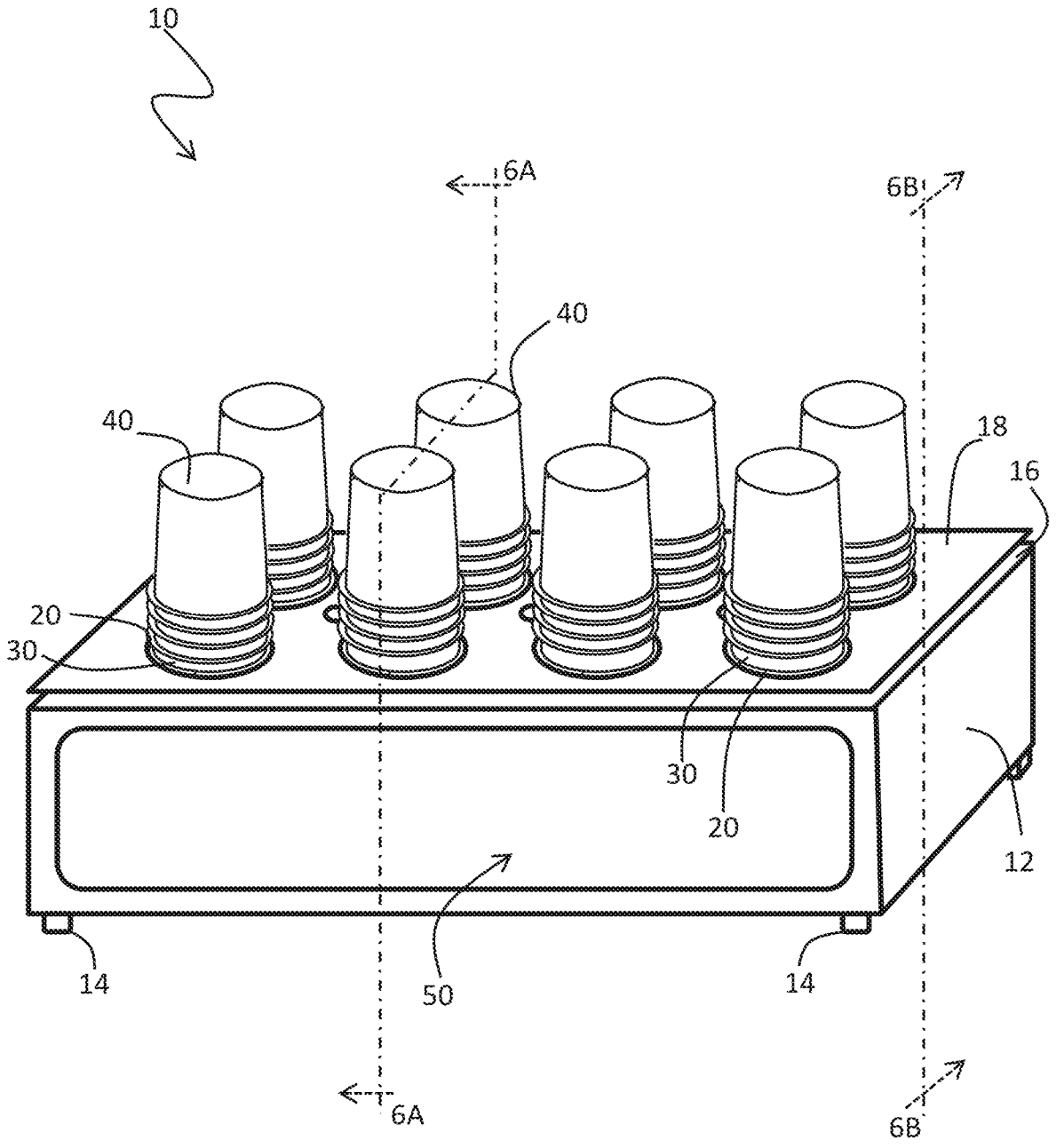
FIG. 5 is a front perspective view of the 4×2 array cup rack shown in FIG. 3 with stacking cups in place.

FIG. 5 is identical to FIG. 3 with the addition of stacking cups 40, and the cross-section planes indicated by line 6A-6A and line 6B-6B. The stacking cups 40 are physically identical to the mounting cups 30, and are stacked vertically, one inside the next, atop the mounting cups 30. The mounting cups 30 act as stabilizing support for the stacking cups 40. Each mounting cup 30 can support a stack of a plurality of stacking cups 40. The mounting cups 30 are stabilized by the interference/press fit between the cup retainer plate 18 and the top planar surface 16.

Figure 6A:
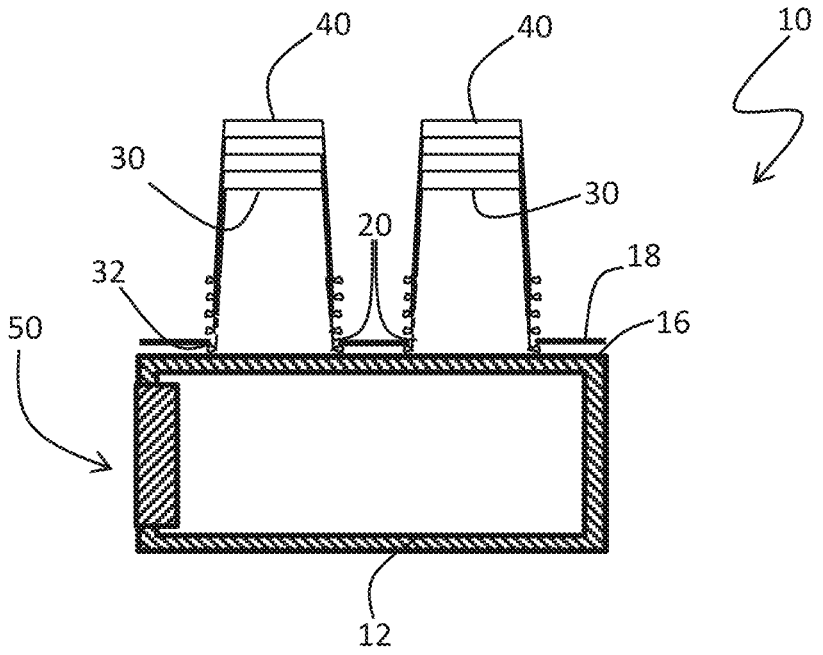
FIG. 6A is a cross-section view of the 4×2 array cup rack in FIG. 5 along the plane containing the line 6A-6A, in the indicated direction.

FIG. 6A is identical to FIG. 4A with the addition of stacking cups 40 atop the mounting cups 30. The stacking cups 40 are physically identical to the mounting cups 30, and are stacked vertically, one inside the next, atop the mounting cups 30. The mounting cups 30 act as stabilizing support for the stacking cups 40. Each mounting cup 30 can support a stack of a plurality of stacking cups 40. The mounting cups 30 are stabilized by the interference/press fit between the cup retainer plate 18 and the top planar surface 16.

Figure 6B:
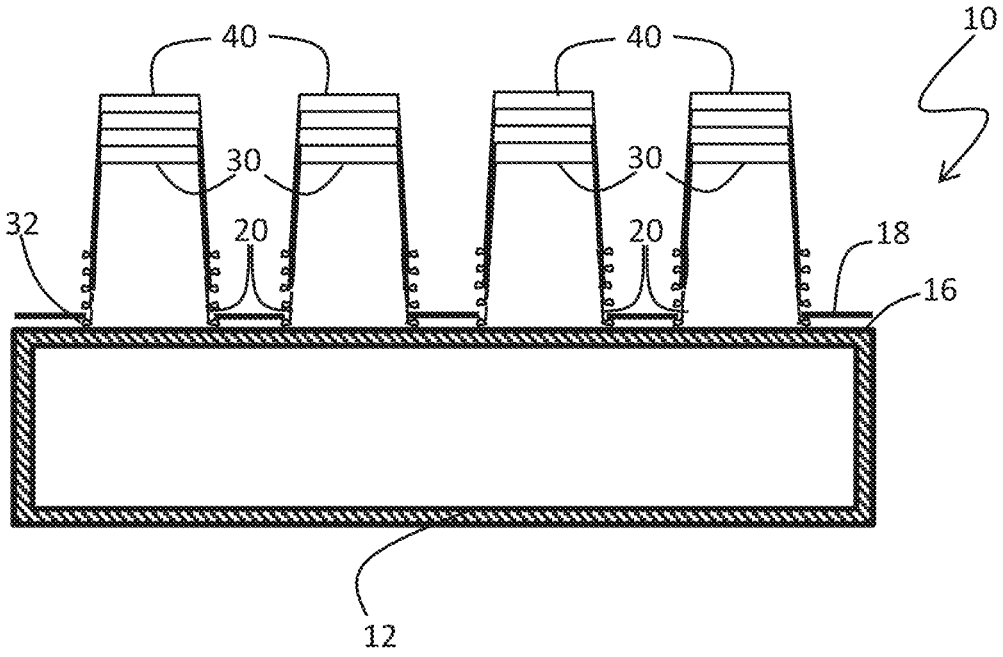
FIG. 6B is a cross-section view of the 4×2 array cup rack shown in FIG. 5 along the plane containing the line 6B-6B, in the indicated direction.

FIG. 6B is identical to FIG. 4B with the addition of stacking cups 40 atop the mounting cups 30. The stacking cups 40 are physically identical to the mounting cups 30, and are stacked vertically, one inside the next, atop the mounting cups 30. The mounting cups 30 act as stabilizing support for the stacking cups 30. Each mounting cup 30 can support a stack of a plurality of stacking cups 40. The mounting cups are stabilized by the interference/press fit between the cup retainer plate 18 and the top planar surface 16.

Figure 7A:
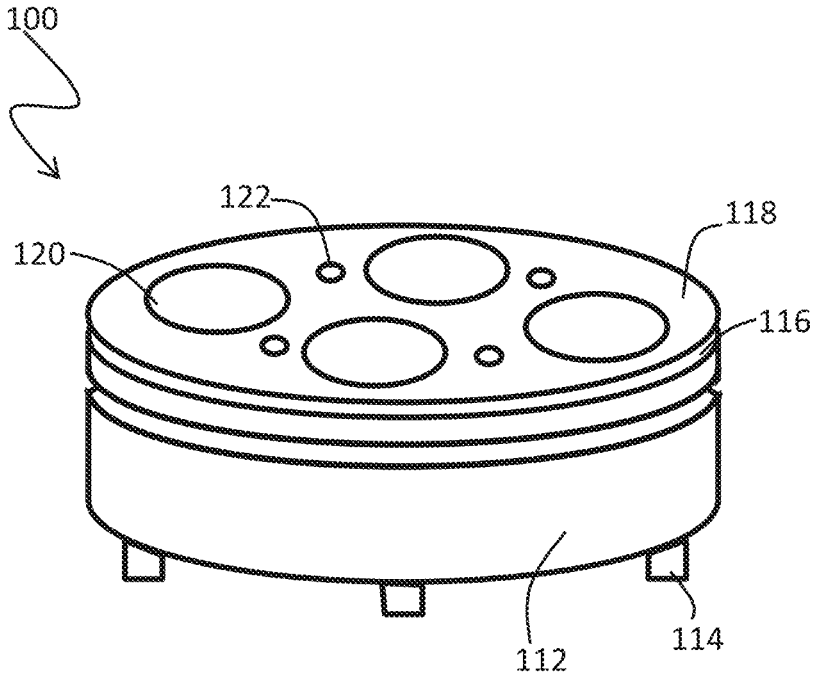
FIG. 7A is a perspective view of a rotating circular array cup rack, with no cups shown.
Figure 7B:
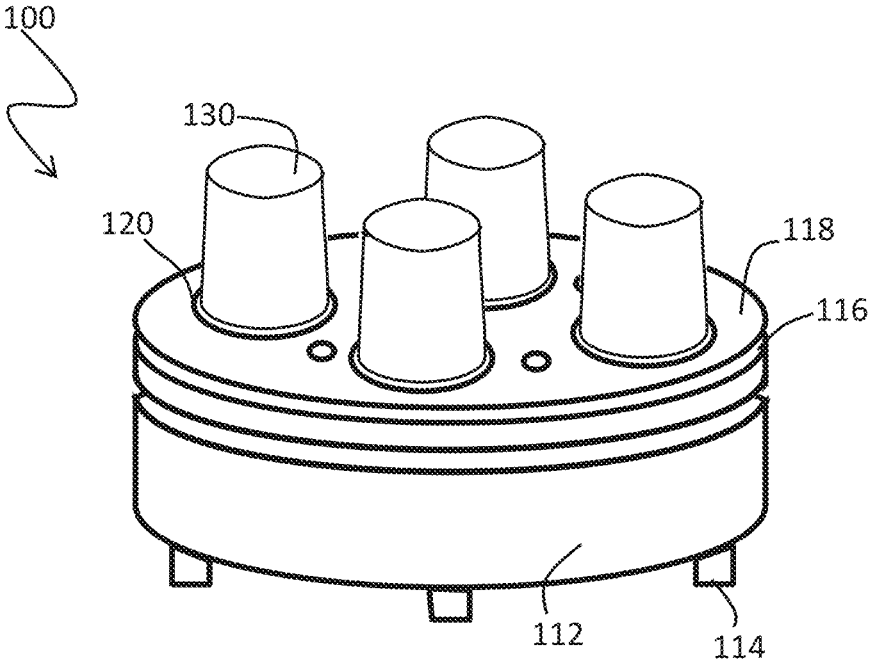
FIG. 7B is a perspective view of the same rotating circular array cup rack, but with mounting cups shown.

FIG. 7A and FIG. 7B illustrate a 'lazy Susan' variant of the cup rack shown in FIG. 1-6, located generally at 100. The cup rack 100 is roughly cylindrical in shape comprising a cylindrical base 112 with a rotating top plate, a circular top planar surface 116 of the rotating top plate and a cylindrical cup retainer plate 118. The base is a circular hollow cylinder with vertical dimension appropriate to holding the circular cylindrical feet 114 and includes any suitable bearing mechanism that allows the rotating top plate that provides the top planar surface 116 to rotate freely about the longitudinal axis through the centre of the base 112. The rotating top plate is connected to the lower portion of the base 112 through mechanical means by which the rotational freedom of the rotating top plate is supported. The cup retainer plate 118 in radial cross section is roughly the same circular dimension as the top planar surface 116. The cup retainer plate 118 is connected to the top planar surface by threaded fasteners exactly as for the rectangular cup rack shown in FIG. 2. The threaded fastener apertures 122 are four and are located near the edge of the cup retainer plate, between pairs of cup retaining apertures 120. FIG. 7A illustrates the cup rack 100 without mounting cups and FIG. 7B shows the assembly with mounting cups 130 in place, with the hull of each mounting cup 130 inserted within a cup retaining aperture 120 and the outwardly flanged rim (not shown) of each mounting cup 130 pressed between the rotating top planar surface 116 and the cup retainer plate 118.

The base 12 of the cup rack 10 illustrated in FIG. 1 to FIG. 6 facilitates mounting of a display in its front face and has space for supporting electronics to be mounted in its hollow interior cavity. Without loss of generality, the following example configurations are contemplated. The display may be a translucent backlit sign. Alternatively, a computing device comprising a display such as a computer tablet may be mounted to the front face of the base, with optional audio equipment mounted in the hollow interior cavity. Another example configuration may be a digital liquid crystal display/light emitting diode display/organic light emitting diode display panel, driven by a computer mounted in the cavity.

TABLE 1

Summary of Reference Numerals Shown in the Drawings.

| Reference No. | Description |
|---|---|
| 10 | Cup rack |
| 12 | Base |
| 14 | Feet |
| 16 | Top planar surface/abutting support of cups |
| 18 | Cup retainer plate |
| 20 | Cup retaining aperture |
| 22 | Fastener aperture |
| 24 | Threaded fastener |
| 26 | Threaded bore |
| 30 | Mounting cup |
| 32 | Outwardly flanged rim |
| 40 | Stacking cup |
| 100 | Rotating Cup rack |
| 112 | Base with rotating top plate |
| 114 | Feet |
| 116 | Top planar surface/abutting support of cups |
| 118 | Cup retainer plate |
| 120 | Cup retaining aperture |
| 122 | Fastener aperture |
| 130 | Mounting cup |

In operation, the cup rack facilitates stacking of disposable cups with outwardly flanged top rims. Such cups are common to the food service industry and the rims are often formed by rolling the material of the cup outwardly back towards the base of the cup. The rim provides structural support for the cup, as well as a flange upon which to attach a cup lid. The symmetry of these cups allows them to be placed one inside the next forming a stack. The cup rack facilitates such stacking by holding the bottom most cup (the mounting cup) fixed to, in turn, provide support for the remaining (stacking) cups. The difference between what is referred to herein as mounting and stacking cups is only their purpose with respect to the application. There is no physical difference between stacking and mounting cups.

Several illustrative variants of the cup rack have been described above. Further illustrative variants and modifications are now described and still further variants, modification and combinations thereof will be recognized by the person of skill in the art.

The cup rack comprises an abutting base surface (also referred to herein as the top planar surface, for descriptions of specific embodiments), and a plate in which there is a plurality of circular apertures (also referred to herein as the cup retainer plate, for descriptions of specific embodiments). The each of the plurality of circular apertures fits over the conical hull of the mounting cup but is not large enough to allow the mounting cup rim to pass through. The retainer plate is fastened tightly to the abutting base surface, compressing the rim of the mounting cup between them. This mechanism makes stable the mounting cup, facilitating the stacking of further identical cups.

The retainer plate may be coupled to the planar surface of the base with any conventional reversible or removable fastener including for example, bolts, clamps, clips, magnets, hooks, hook and pile, snaps, and the like.

FIG. 2-6 show cups with outwardly flanged rims being used as mounting cups. The cup rack can also be used with cups devoid of any flanged rim as a mounting cup. For example, Styrofoam cups devoid of a flanged rim may be captured within a circular aperture of the retainer plate by a friction fit. The cup rack may be adapted to hold any stackable receptacle for consumable liquids with or without a flanged rim including for example, a coffee cup, a tea cup, a soup cup, a soup bowl, cups or bowls made of materials comprising paper, polymer plastics (eg. polyethylene terephthalate or polylactic acid, or polymer foams (eg., expanded polystyrene foam), cups or bowls comprising disposable, reusable, recyclable, or biodegradable materials, and the like. When the stackable receptacle has a flanged rim the circular apertures can be sized to trap or retain the flanged rim while allowing the remainder of the receptacle to pass through the circular aperture. When the stackable receptacle does not have a flanged rim the circular aperture is sized to trap or retain the rim of the receptacle or a portion proximal to the rim by a friction/interference fit.

Mounting cups and stacking cups may be of the same or substantially the same dimensions. Where the mounting cups and stacking cups are different, typically the mounting cups will be smaller than the stacking cups in that the volume bounded by the exterior dimensions of the mounting cup will be smaller than the volume bound by exterior dimensions of the stacking cup. Generally, if the volume bound by the exterior dimensions of the mounting cup is less than the volume bound by the exterior dimensions of the stacking cup, then the difference between the mounting cup volume and stacking cup volume is less than 10%, more typically less than 5%, 4%, 3%, 2%, 1% or less than any percentage therebetween.

The cup retaining apertures can be any size allowed by manufacturing but should correspond directly to the size of cup which they are designed to support. The radius of the cup retaining aperture should be such that it fits over conical hull of its respective cup, but the rim of the cup, with or without an outward flange depending on the type of cup being stacked, cannot pass through.

The cup retaining aperture will have a diameter that is smaller than the largest exterior diameter of the cup that it is intended to receive. For cups with conical hulls the largest exterior and interior diameters occur at or proximal to the rim of the cup. For cups without an outwardly extending flange at the rim the difference between the largest exterior and interior diameters is typically the thickness of the cup at its rim. This thickness is variable but typically ranges from 0.05 millimeters to 2 millimeters. For cups that include an outwardly extending flange at the rim the largest exterior diameter is measured across diametrically opposing points of the external edge of the flange and the difference between the largest exterior and interior diameters is greater than the material thickness at the rim of the cup as the radial distance of the flange must be taken into account. Regardless of whether the rim is flanged or not, the cup retaining aperture will be sized to have a diameter less than the largest exterior diameter. The cup retaining aperture will typically be sized to have a diameter that is less than the largest exterior diameter of the cup and greater than or equal to the largest interior diameter of the cup, but for the convenience of a particular application the cup retaining aperture may be less than the largest interior diameter of the cup. As the cup retaining aperture is progressively decreased in diameter to be significantly less than the largest interior diameter of the cup, the cup retaining aperture captures a portion of the conical hull of the cup that is progressively axially distal from the rim and the cup retainer plate can be spaced accordingly from the abutting base surface. Generally, if the cup retaining aperture has a diameter less than the largest interior diameter of the cup, then the difference between the cup retaining aperture diameter and the largest interior diameter of the cup is less than 10%, more typically less than 5%, 4%, 3%, 2%, 1% or less than any percentage therebetween.

The cup retaining aperture need not have a uniform diameter along its axial length. The cup retainer plate is bound by first and second opposing parallel surfaces with the first surface facing the top planar surface when the cup retainer plate is fixed to the base and the second surface providing abutting support for stacking cups on the mounting cup. As shown in the cross-section views of FIG. 4 and FIG. 6 the cup retaining aperture cylindrical sidewall is perpendicular to the first and second surfaces of the cup retainer plate such that the cup retaining aperture provides a uniform or constant diameter at each point along the axial length of the cup retaining aperture from the first surface to the second surface. However, a non-uniform or varying diameter of the cup retaining aperture is also contemplated. For example, the cup retaining aperture may be tapered so that the cup retaining aperture on the second surface of the cup retainer plate is narrower than it is on the first surface of the cup retainer plate. The intention of this design feature would be to increase pressure in the radial directions, securing the cup from motion in the plane of the top planar surface of the base. Another advantage of this feature is that the tapered cup retaining aperture can achieve an interference/press fit of an outwardly extending flange without crushing the flange as the taper provides space for accommodating the radial extension of the flange. Furthermore, in applications where the cup retaining aperture captures the conical hull of the cup proximal to but not at the rim, a tapered cup retaining aperture may provide an improved interference/press fit by substantially matching the angle of the taper to the angle of the conical hull.

A mounting cup captured at or proximal to its rim by a cup retaining aperture constitutes a reversible connection between the mounting cup and the cup retainer plate. The connection between the mounting cup and the cup retainer plate may be further bolstered by a permanent fixative or integral bonding as desired. Integral molding of the mounting cup with the cup retainer plate is also contemplated. However, permanent fixation or integrated connection is not as adaptable to different cup types as a reversible connection.

The cup retaining plate should be roughly the same size as the abutting base. If the cup retaining plate is larger than the abutting base, then the overhung corners superfluously occupy space, and provide a hazard in operation for catching clothing or being bumped by users. If the retaining plate is too small, then area for retaining apertures is not used optimally, and spills may be allowed into the gap between the two plates, making sanitation more difficult. The cup retaining plate will typically be equal or slightly smaller than the abutting planar surface of the base. Generally, if the cup retaining plate has a circumference/perimeter less than the circumference/perimeter of the abutting planar surface of the base, then the difference between the cup retaining plate circumference/perimeter and the circumference/perimeter of the abutting planar surface of the base is less than 10%, more typically less than 5%, 4%, 3%, 2%, 1% or less than any percentage therebetween.

Assembly of the cup rack prior to use can be achieved through any convenient method that results in cups being vertically/axially immobilized within the cup retaining apertures. For example, assembly of the cup rack may involve placing the cups in corresponding appropriately sized cup retaining apertures and fastening the cup retainer plate onto the top planar surface/abutting support of the cups. In another example, the cups can be placed in appropriate order (corresponding to the configuration of holes on the cup retainer plate) on top of the abutting base surface. The retainer plate is then lowered over the cups, allowing the conical hulls of the cups to pass through the cup retaining apertures. When the cup retainer plate is fully lowered it is resting on the rims of the cups or capturing the conical hull of the cup proximal to or at the rim of the cup. The cup retainer plate is then fastened to the base plate, and tightened to compress the rims, forming an interference fit. Remaining cups may then be stacked on top of the first to a desired height or a height limited by the mechanical structure of the stack. Disassembly of the cup rack may be accomplished by removing the fasteners fixing the retainer plate to the base, then removing the retainer plate, then removing the cups.

Although mounting cups will typically be placed with abutting support on a base surface in conjunction with an interference/press fit in a cup retaining aperture, other means of providing abutting support are also contemplated. For example, a screen may be slidably coupled or coupled by snap fit to the first surface of the cup retainer plate such that the screen may be moved to insert cups within the cup retaining apertures and then once the cups are fully inserted within the cup retaining apertures the screen may be placed in a position to abut the rims of the inserted cups. In one example, the screen may comprise a plurality of apertures sized to allow a cup to fully pass through and be inserted with the screen moveable from a first open position where the screen apertures are aligned with the cup retaining apertures to a second position where the screen apertures are offset from the cup retaining apertures. In the first position the cup passes through the screen aperture and is captured within the cup retaining aperture and in the second position the screen provides an abutting support for the cup captured within the cup retaining aperture. If a screen is used in absence of a prominent base (ie., the base is prominent by having a greater surface area than the cup retainer plate) then the screen becomes the abutting base surface.

In the illustrative variants of the cup rack shown in the drawings, the cup retainer plate is fastened to the base with threaded fasteners. The threaded fasteners may be replaced. Alternatives for fixing and tightening the cup retainer plate to the base include clips, clamps, pins, flanged interference fit, and other reversible fasteners. This includes variations on the fastener, such a nut and bolt fasteners or captive inserts with threaded fasteners. Furthermore, the cup retainer plate may be hingedly coupled to the base with a reversible fastener used to fix the cup retainer plate and the base together so that the cup retainer plate can be moved pivotably from a first fastened position parallel to the top planar surface of the base to a second unfastened position at an angle relative to the top planar surface of the base to allow for clearance to insert cup within the cup retaining apertures. Similarly, the cup retainer plate may be coupled to the base using one or more telescopic shafts with the cup retainer plate and the base connected to opposing ends of the telescopic shaft(s). In yet another illustrative variant, a combination of a pivotable and telescopic coupling may be used, for example a telescopic shaft that can retractably extend from the base with a pivotable coupling of the shaft to the retainer plate at an extended end of the shaft. Yet another variant, includes a slidable coupling of the retainer plate and the base such as may be provided by a tongue and groove or a track and bearing configuration.

The number, shape, size and arrangement of the cup retaining apertures may readily be varied to suit a specific application. Two illustrative variants shown in the drawings, provide a rectangular grid arrangement of four rows and two columns (FIG. 1-FIG. 6), and a circular arrangement on a rotating base (FIG. 7). Alternatives include, for example, stair-step grids in which rows, columns or individual apertures are arranged at selected relative heights. Configurations may also include storage, stacking and display bays for cup lids, straws and/or other accessories. Variations of the base may be designed for specific deployments, such as placement of water cooler bottles, mounted to soda dispensing machines or fixed to the base of coffee makers.

The cup rack described herein provides several advantages. For example, it is easy to clean around assemblies of the cup rack and to maintain sanitation of the assembly. The assemblies can be seated atop counters so that they are not prone to soiling and are easily maintained. They require no specialized tools for installation and are easily replicable. The cup rack provides a stable platform for supporting stacks of stackable cups.

For further sanitary consideration, the cup rack may include a sanitary plate or cover that may be positioned to abut and cover the cup retainer plate such that the retainer plate is positioned between the sanitary plate and the abutting planar surface of the base in a parallel alignment. The cup retainer plate will typically have a circumference/perimeter that is equal to or less than the circumference perimeter of the sanitary plate. Generally, if the cup retaining plate has a circumference/perimeter less than the circumference/perimeter of the sanitary plate, then the difference between the cup retaining plate circumference/perimeter and the circumference/perimeter of the sanitary plate is less than 10%, more typically less than 5%, 4%, 3%, 2%, 1% or less than any percentage therebetween. The sanitary plate will comprise a plurality of apertures that are substantially similar in size and co-aligned with the plurality of cup retaining apertures of the cup retainer plate. Typically, an aperture of the sanitary plate will have a diameter equal or less than a corresponding aperture of the cup retainer plate. Generally, if the aperture of a sanitary plate has a diameter less than the diameter of a corresponding cup retaining aperture of the cup retainer plate, then the difference between the sanitary plate aperture diameter and the corresponding cup retaining aperture diameter of the cup retainer plate is less than 10%, more typically less than 5%, 4%, 3%, 2%, 1% or less than any percentage therebetween. Other than apertures that are similar in size and co-aligned with the cup retaining apertures of the cup retainer plate the sanitary plate will be devoid of other apertures and will be substantially continuous and impermeable to liquids. In use, once the cup retainer plate is reversibly fixed to the base plate trapping rims of the mounting cups therebetween the sanitary plate is positioned with circular apertures allowing the hulls of the mounting cups to pass therethrough with the sanitary plate in parallel alignment with the cup retainer plate and a first surface of the sanitary plate abutting and/or covering the second surface of the cup retainer plate. The stacking cups can then be stacked on each of the mounting cups with a rim of the first stacked cup abutting a second surface of the sanitary plate. The purpose of the sanitary plate is to provide a cover for the retainer plate that can be easily placed on or removed from a covering position of the cup retainer plate while keeping the mounting cups in place. Thus, the sanitary plate can easily be removed for cleaning purposes without requiring disassembly of the cup retainer plate and mounting cups. Use of the sanitary plate will significantly decrease the need to clean the retainer plate or any crevice that may exist between the retainer plate and the base in an assembled position.

The sanitary plate may be freely removable from the cup retainer plate in that it simply rests on the cup retainer plate and is not fastened to the cup retainer plate so that it may be manually removed by simply lifting it off of the cup retainer plate. Alternatively, the sanitary plate may be reversibly fastened to the cup retainer plate and/or the base with a reversible fastener such as magnets, clips, snaps, hooks, hook and pile (eg., Velcro) and the like. In examples, where the sanitary plate is coupled to the cup retainer plate using a reversible fastener the force required to remove the sanitary plate from the cup retainer plate will be less than the force required to remove the cup retainer plate from the base so that removal of the sanitary plate does not cause unintended removal of the cup retainer plate.

Optionally, the cup rack may include electronics for signage or advertising displays. This may simply be embedded tablets, or single-board computers with LCD/OLED or other display. The cup rack base may include structures for holding electronics such as a bay, a window or brackets to hold digital displays, tablets and the like.

The base may provide a surface for mounting an electronic display. The cavity of the base can be fitted with brackets and stand-offs as needed to mount electronics for specific applications of mounting an electronic display. For example, a tablet may be seated across an opening formed in a surface of the base communicative with the cavity, set in a grove and held in place by a rotating bracket mounted to the inside of the cavity. If printed circuit boards are needed for electronics, they may be fastened onto standoffs which are threaded into the inner surfaces of the bottom, top or sides of the base. Any convenient mechanism for safely securing an electronic display may be used.

The electronic display may accommodate any type of computing device provided the computing device is configured to display text and/or images. For example, the computing device may be a desktop, laptop, notebook, tablet, personal digital assistant (PDA), PDA phone or smartphone, gaming console, portable media player, and the like. The computing device may be implemented using any appropriate combination of hardware and/or software configured for wired and/or wireless communication over a network. The computing device hardware components such as displays, storage systems, processors, interface devices, input/output ports, bus connections and the like may be configured to run one or more applications to allow, for example, an image to be manipulated from a displayed document, receiving actions and optionally action parameters associated with the image, representing the actions in a graphic overlay at or near the image, and/or a selection of an action in the graphic overlay.

Optionally, the computing device may be networked to a remote server. The server computer may be any combination of hardware and software components used to store, process and/or display images and/or actions associated with the desired implementation of the cup rack. The server computer components such as storage systems, processors, interface devices, input/output ports, bus connections, switches, routers, gateways and the like may be geographically centralized or distributed. The server computer may be a single server computer or any combination of multiple physical and/or virtual servers including for example, a web server, an image server, an application server, a bus server, an integration server, an overlay server, a meta-actions server, and the like. The server computer components such as storage systems, processors, interface devices, input/output ports, bus connections, switches, routers, gateways and the like may be configured to run one or more applications.

When a network is used, the network may be a single network or a combination of multiple networks. For example, the network may include the internet and/or one or more intranets, landline networks, wireless networks, and/or other appropriate types of communication networks. In another example, the network may comprise a wireless telecommunications network (e.g., cellular phone network) adapted to communicate with other communication networks, such as the Internet. Typically, the network will comprise a computer network that makes use of a TCP/IP protocol (including protocols based on TCP/IP protocol, such as HTTP, HTTPS or FTP).

The computing device and/or the server may be configured to follow any computer communication standard including Extensible Markup Language (XML), Hypertext Transfer Protocol (HTTP), Java Message Service (JMS), Simple Object Access Protocol (SOAP), Lightweight Directory Access Protocol (LDAP), and the like.

The electronic display and/or the computing device and/or the server computer may accommodate any type of still or moving image file including JPEG, PNG, GIF, PDF, RAW, BMP, TIFF, MP3, WAV, WMV, MOV, MPEG, AVI, FLV, WebM, 3GPP, SVI and the like. Furthermore, a still or moving image file may be converted to any other file without hampering the ability of the computing device and/or server software to communicate and/or process the image. Thus, the electronic display may accommodate any image file type and may function independent of a conversion from one file type to any other file type.

The computing device may allow end user interaction through any convenient user interface element including, for example, a window, a tab, a text box, a button, a hyperlink, a drop-down list, a list box, a check box, a radio button box, a cycle button, a datagrid or any combination thereof. Furthermore, the user interface elements may provide a graphic label such as any type of symbol or icon, a text label or any combination thereof. Any desired spatial pattern or timing pattern of appearance of user interface elements may be accommodated.

The cup rack may be arranged in various assembly configurations for customized deployment. The primary mechanism by which the cup rack functions may be applied in arbitrary arrangements in conjunction with a given delivery platform. For example, the mechanism may be applied in a rectangular M×N array atop a podium (such as the 4×2 array illustrated in FIG. 1), or an in a circular chain on a rotating platform (that is, the so-called lazy Susan, illustrated in FIG. 7). The cup rack may be configured in any shape or size as desired. For example, the cup retainer plate and the abutting base surface may be a circle, ellipse, triangle, square, pentagon, hexagon, or any other polygon, irregular shape or a shape including a recognized logo or trademarked shape or design. Furthermore, the abutting base surface need not be horizontal, but will typically not be vertical. The abutting base surface may be any convenient combination of angles including a horizontal portion and an angled portion. Furthermore, the base may include any shape or size of extending back panel, side, panel, front panel, or any combination thereof. For example, a pair of parallel side panels may extend perpendicularly from the abutting base surface to provide a pair of parallel side walls that brackets the abutting base surface. In another example, a back panel may extend perpendicularly from the abutting base surface and optionally join a side wall at each opposing edge of the back panel to form a three-sided enclosure that brackets the abutting base surface. The side panels and back panel may be of any desired size or shape and include profiles or shapes that may be circular, square, curved, triangular, and the like. The back panel may be connected to or free of the side panels as desired. The back panels, side panels, or front panels may extend at differing independent lengths or similar lengths from the abutting base surface as desired. The panels will typically extend at perpendicular or substantially perpendicular angles with respect to the abutting base surface. However, other angles may be accommodated including for example, angles greater than 45 degrees. Generally, a parallel orientation of one or more panels to the abutting base surface will be avoided. Video displays as described above may be installed in any of the back, side or front panels with electronic circuitry supported by the back, front and/or side panel and/or within the base. The cup rack and any extending panel may be any size or shape as long as it includes an abutting base surface and a cup retainer plate to achieve an interference/press fit to hold mounting cups in place.

These examples of specific assemblies of the cup rack are for illustrative purposes and are included without intended loss of generalities.

Several variants of the cup rack have been described for illustrative purposes. Still further variants, modifications and combinations thereof are contemplated and will be recognized by the person of skill in the art. Accordingly, the foregoing detailed description is not intended to limit scope, applicability, or configuration of claimed subject matter.

What is claimed is:

1. A receptacle rack comprising:

a base providing a surface for abutting support for a retainer plate and a plurality of mounting receptacles;

the retainer plate coupled to the base;

the plurality of mounting receptacles integrally molded to the retainer plate;

the retainer plate moveable from a first closed position parallel and proximal to the surface for abutting support to a second open position;

a back panel extending from the base, the back panel substantially perpendicular relative to the surface for abutting support, an electronic display installed in the back panel.

2. The receptacle rack of claim 1, further comprising a side panel extending from the base, the side panel substantially perpendicular relative to the surface for abutting support.

3. The receptacle rack of claim 1, further comprising a pair of side panels extending from the base, each of the pair of side panels substantially perpendicular relative to the surface for abutting support.

4. The receptacle rack of claim 3, wherein each of the pair of side panels joins an opposing edge of the back panel to form a three sided enclosure that brackets the surface for abutting support.

5. The receptacle rack of claim 1, wherein electronic circuitry for the electronic display is supported in the back panel.

6. The receptacle rack of claim 1, wherein electronic circuitry for the electronic display is supported in the back panel and the base.

7. The receptacle rack of claim 1, wherein the retainer plate is reversibly fastened to the base.

8. The receptacle rack of claim 1, further comprising a sanitary plate positioned to cover the retainer plate, the sanitary plate comprising a plurality of apertures that are equal in number and are co-aligned with the plurality of mounting receptacles, the circumference of the sanitary plate being equal to or greater than the circumference of the retainer plate.

9. The receptacle rack of claim 1, wherein the electronic display is configured for communication with a computer network.

10. The receptacle rack of claim 1, wherein the receptacle rack is a cup rack and the plurality of mounting receptacles is a plurality of mounting cups, each of the plurality of mounting cups comprising a conical hull and a rim.

11. The receptacle rack of claim 1, wherein the receptacle rack is a bowl rack and the plurality of mounting receptacles is a plurality of mounting bowls.

12. A receptacle rack comprising:

a base providing a surface for abutting support for a retainer plate and a plurality of mounting receptacles;

the retainer plate coupled to the base;

the plurality of mounting receptacles integrally molded to the retainer plate;

the retainer plate moveable from a first closed position parallel and proximal to the surface for abutting support to a second open position.

13. The receptacle rack of claim 12, wherein the base comprises a rotating plate providing the surface for abutting support.

14. The receptacle rack of claim 12, further comprising an electronic display mounted to a surface of the base and electronic circuitry for operation of the electronic display housed within the base.

15. The receptacle rack of claim 12, further comprising a sanitary plate positioned to cover the retainer plate, the sanitary plate comprising a plurality of apertures that are equal in number and are co-aligned with the plurality of mounting receptacles, the circumference of the sanitary plate being equal to or greater than the circumference of the retainer plate.

16. The receptacle rack of claim 12, wherein the retainer plate is reversibly fastened to the base.

17. The receptacle rack of claim 12, wherein the retainer plate is hingedly coupled to the base.

18. The receptacle rack of claim 12, wherein the retainer plate is slidably coupled to the base.

19. The receptacle rack of claim 12, wherein the receptacle rack is a cup rack and the plurality of mounting receptacles is a plurality of mounting cups, each of the plurality of mounting cups comprising a conical hull and a rim.

20. The receptacle rack of claim 12, wherein the receptacle rack is a bowl rack and the plurality of mounting receptacles is a plurality of mounting bowls.

* * * * *